US008951139B2

(12) United States Patent
Prenzel

(10) Patent No.: US 8,951,139 B2
(45) Date of Patent: Feb. 10, 2015

(54) PRACTICE DEVICE, USE OF A PRACTICE DEVICE AND METHOD FOR CHECKING THE ALIGNMENT OF THE LONGITUDINAL AXIS OF A PERSON'S BODY

(76) Inventor: Michael Prenzel, Quackenbrück (DE)

( * ) Notice: Subject to any disclaimer, the term of this patent is extended or adjusted under 35 U.S.C. 154(b) by 244 days.

(21) Appl. No.: 13/812,971

(22) PCT Filed: Jul. 22, 2011

(86) PCT No.: PCT/EP2011/003676
§ 371 (c)(1),
(2), (4) Date: Jan. 29, 2013

(87) PCT Pub. No.: WO2012/016643
PCT Pub. Date: Feb. 9, 2012

(65) Prior Publication Data

US 2013/0130821 A1 May 23, 2013

(30) Foreign Application Priority Data

Aug. 5, 2010 (DE) ..... 10 2010 033 475

(51) Int. Cl.
*A63B 69/36* (2006.01)

(52) U.S. Cl.
CPC ..... *A63B 69/3667* (2013.01); *A63B 69/3623* (2013.01); *A63B 2069/3629* (2013.01)
USPC ..... 473/270; 473/409

(58) Field of Classification Search
USPC ..... 473/218, 257, 266, 268, 269, 270, 409
See application file for complete search history.

(56) References Cited

U.S. PATENT DOCUMENTS 3,857,570 A * 12/1974 Gutierrez et al. ..... 473/264
4,032,157 A 6/1977 Carpenter (Continued)

FOREIGN PATENT DOCUMENTS

DE 10039494 A1 2/2002
JP 61091270 U 6/1986

(Continued)

*Primary Examiner* — Nini Legesse
(74) *Attorney, Agent, or Firm* — Laurence P. Colton; Smith Risley Tempel Santos LLC

(57) ABSTRACT

When golf is being played, the golf swing of a person (60) is decisive for the quality of the stroke. In order to obtain as good a golf swing as possible with a high hitting reliability and with precision, it is necessary to rotate the club with the arms (70) in a positionally fixed fashion about an imaginary axis through the head (68) and upper body (66). In order to monitor said positionally fixed rotation, it is generally necessary to consult a second person. Specifically, independent checking is possible only with difficulty. The object of the invention is therefore to provide a practice device (10) with which it is possible to check the position of the imaginary axis independently and without help from further persons in order to be able to practice the optimum golf swing even on one's own. The object is achieved by a practice device (10) according to the invention. The practice device (10) has at least two lateral faces (18, 20) aligned substantially perpendicular to the underlying surface and with a distance between them that corresponds at least substantially to the human interocular distance. By positioning the practice device (10) on the underlying surface (28), it is therefore possible to visually determine even slight lateral deviations from a central ideal position above the practice device (10) by lateral faces (18, 20) that are correspondingly more or less visible.

29 Claims, 4 Drawing Sheets

(56) References Cited

U.S. PATENT DOCUMENTS

| | | | | |
|---|---|---|---|---|
| 5,007,646 | A * | 4/1991 | Baber et al. | 473/261 |
| 5,482,284 | A | 1/1996 | Vandever | |
| 5,527,037 | A | 6/1996 | Matsumoto | |
| 5,549,298 | A | 8/1996 | Cullen | |
| 6,612,937 | B1 | 9/2003 | Whelan | |
| 6,722,998 | B1 | 4/2004 | Miller | |
| 2002/0098902 | A1 | 7/2002 | Rodriguez | |
| 2006/0154737 | A1 | 7/2006 | Moussa | |
| 2007/0232406 | A1 | 10/2007 | Grant | |

FOREIGN PATENT DOCUMENTS

| | | | |
|---|---|---|---|
| WO | 9602304 | A1 | 2/1996 |
| WO | 2010001129 | A1 | 1/2010 |

* cited by examiner

PRACTICE DEVICE, USE OF A PRACTICE DEVICE AND METHOD FOR CHECKING THE ALIGNMENT OF THE LONGITUDINAL AXIS OF A PERSON'S BODY

STATEMENT OF RELATED APPLICATIONS

This patent application is the US Chapter II National Phase of International Application No. PCT/EP2011/003676 having an International Filing Date of 22 Jul. 2011, which claims priority on German Patent Application No. 10 2010 033 475.8 having a filing date of 5 Aug. 2010.

BACKGROUND OF THE INVENTION

1. Technical Field

The invention relates to a practice device for checking the alignment, in particular, of a body part and/or a longitudinal axis of the body of a person. The invention further relates to the use of a practice device. Finally, the invention relates to a method for aligning, in particular, the longitudinal axis of the body and/or a body part of a person relative to an underlying surface.

2. Prior Art

When golf is being played, a golf ball is struck by a person, in particular a golfer, with the aid of a golf club. The so-called golf swing with which the golf club is moved by the person's use of his/her body relative to the golf ball is decisive for an accurately directed and successful execution of a strike. A good golf swing is distinguished in that the club is rotated with the aid of the arms, the shoulders and the upper body about an imaginary axis, the so-called longitudinal axis of the body through the head and backbone. It is largely undesired in this case for there to be a displacement of this axis during the golf swing, for example laterally or forward and/or back by movement of the upper body.

It is usual for the axis to be maintained during the golf swing by having a further person, such as a golf teacher, to monitor it by observing the golfer. This is required because the golfer himself has virtually no possibility to observe the alignment of his own body axis during his movement. It is therefore necessary in general to consult a second person for practice. It is therefore, in particular, impossible for him to improve his golf swing independently without the help of a third party.

BRIEF SUMMARY OF THE INVENTION

It is an object of the present invention to provide a golfer with a practice device that can be easily handled and enables the golf swing to be practiced independently.

This object is achieved by a practice device for checking the alignment of a person, in particular a golfer, by the person him/herself and relative to an underlying surface, having a many-faced basic body with at least two lateral faces, and having means for setting up on an underlying surface, at least two of the lateral faces being aligned at least substantially perpendicular to an imaginary plane running through the setting up means, and the two lateral faces being arranged at a distance apart from each other that corresponds at least substantially to a human interocular distance. Accordingly, a practice device is provided that serves to check the alignment of a person, in particular a golfer, by the person him/herself. The alignment is undertaken relative to the practice device and/or to an underlying surface. To this end, the practice device has a many-faced basic body with at least two lateral faces. Also provided are means for setting up the practice device on an underlying surface. At least two of the lateral faces are aligned at least substantially perpendicular to an imaginary plane running through the setting up means. In the case of setting up on an underlying surface, said plane then runs at least substantially parallel to the underlying surface. Moreover, the at least two lateral faces are arranged at a distance apart from each other that corresponds at least substantially to an (average) human interocular distance. The at least two faces are arranged running perpendicular to an imaginary plane. Said plane corresponds to a horizontal plane for setting up on an underlying surface. The result of this is that the two lateral faces run perpendicular to the underlying surface. By virtue of the fact that the two lateral faces are at a distance from one another that corresponds approximately to a human interocular distance, a person can preferably respectively look with in each case one of his two eyes along respectively one of the lateral faces, that is to say with the left eye along a left-hand lateral face and with the right eye along a right-hand lateral face. In this position of the head and/or eyes, each of the two eyes is situated in the plane of each of the two lateral faces. Even slight deviations from this position can therefore easily be detected visually. Given increasing lateral deviations, instead of the upper edge of the lateral faces it is an increasing partial face of the lateral face that becomes visible. This is at least the case on the side of the practice device to which the head and/or the person has moved. Since the second eye does not simultaneously likewise move laterally next to, but first in the direction of the middle of, the practice device, it is a diminishing part of the surface of the corresponding lateral face or only the lateral edge that becomes visible there. Consequently, the necessary counter-movement in the other direction can easily be determined and undertaken in order to compensate the deviation from the central position.

It is preferred for the distance between the two lateral faces to correspond at least substantially to the interocular distance of the person using the device. In particular, the distance is between 5 cm and 8 cm. In particular, the distance is approximately 6.5 cm. A distance of 6.5 cm corresponds to the average interocular distance for humans. This is sufficient for most applications. However, since the interocular distance can vary among humans, the distance can be matched in particular to the interocular distance of the respective user. It is therefore further preferred for the distance between the two lateral faces to be of variable configuration. This can, for example, be achieved by a parallel displacement, in particular with the aid of a parallel feed, a screw gear or similar. It is thereby possible to set the distance appropriately depending on each user. Also considerable are practice devices with various distances for a user to select, or even customized versions of the practice device.

The practice device or the basic body preferably has several, in particular six, preferably eight outer faces. Furthermore, the practice device or the basic body of the practice device is designed to be in the shape of a polyhedron, a pyramidal frustum, a cuboid, a cube or the like, or has at least one basic shape corresponding thereto. Furthermore, at least one, preferably four, with particular preference six, and with further preference eight outer faces is/are present. At least two or preferably four of the outer faces are preferably designed as lateral faces. A top face and/or a bottom face are preferably present as outer faces. This corresponds exactly to the, in particular, six outer faces that, for example, are present in the case of a cuboid or cube. At least one of the outer faces, preferably however all the outer faces, is/are preferably designed as at least partially flat faces. It is further preferred to arrange the outer faces, in particular, opposite in pairs and/or parallel to one another. The outer faces thereby preferably form the outer walls or the outer boundary of the basic body. The bottom face preferably serves as means for setting up on the underlying surface. In particular, the lateral faces are arranged at least partially perpendicular to the setting up means, in particular to the bottom face and/or to the underlying surface. It is further preferred for the bottom face and/or the top face to be arranged at least substantially parallel to the underlying surface.

In particular, the lateral faces are designed as flat faces. The lateral faces are, in particular, designed as rectangular and/or square faces. It is further preferred for the lateral faces to be designed with color, preferably a single color, in particular homogeneously. This aim can be shared, for example, by signal colors such as, in particular, the colors red, yellow, blue or similar. It is preferred to select a color that stands out clearly from a normally used underlying surface. In the case of golf, the underlying surface is generally green grass or yellow sand of a golf course. Accordingly, the complementary color red can be effectively perceived. However, particularly for color-blind persons, for example, red-green blind persons, it is also possible to provide another coloration, in particular yellow and/or blue, which ensures as strong a contrast as possible with the underlying surface and with the remaining faces of the practice device. With further preference, a marking is arranged on the top face of the basic body, preferably centrally. By way of example, a bar, a line, a cutout or the like can serve as marking. The marking is preferably designed to be black. The line serves to indicate the middle of the basic body and/or the direction in which a user looks. The top face of the basic body is, with further preference, designed in a color that matches the underlying surface as far as possible, and/or preferably in green.

The practice device or the basic body is preferably assigned an alignment indicator. The alignment indicator can preferably be detachably connected to the basic body or practice device. For the purpose of connection to the basic body, a cutout, opening or holder is, in particular, provided therein. The connection between the alignment indicator and the practice device is preferably performed by screws, plugs or the like. The alignment indicator is preferably of T-shaped design. With further preference, the alignment indicator has several, in particular three preferably bar- and/or rod-shaped elements or bars. The elements can, in particular, be detachably connected to one another, in particular in the region of a coupling part such as a coupling sleeve. One bar serves to connect the basic body to the coupling sleeve. The remaining two bars are connected to the latter in a fashion that is mutually collinear and perpendicular to the end region of the bar, which is opposite the basic body. The two collinear bars are arranged perpendicular to said bar.

It is further preferred to provide two opposite outer faces, in particular a front face and a rear face of the practice device or of the basic body. In this case, the outer faces, in particular the front face and/or the rear face, preferably respectively have a cutout or notch. This notch is in particular of identical design for the front and rear sides. The notch is preferably designed in the shape of a wedge and/or a V. Consequently, the cross-sectional surface of the cutout is preferably of triangular design, in particular in the form of an equilateral triangle. The cutout is preferably arranged centrally on the corresponding face. With further preference, the cutout extends over the entire lateral face, preferably at least substantially in a vertical direction. This means, in particular, that the notch extends from the top face to the bottom face of the basic body. The cutouts and/or notches of two opposite lateral faces are preferably aligned running parallel to one another. The lateral faces of the notch that run together to a tip, that is to say the two partial faces thereof, therefore point toward the middle of the basic body. They are therefore aligned in a fashion opposite or opposed to one another. They preferably respectively point into the basic body. The cross section in a horizontal direction of the notch can, but need not, be constant. In particular the face size can vary given the same relationships. The notches or cutouts ensure that even a deviation of the positioning in the forward and backward directions can be determined by a person. The lateral deviations become visually detectable or measurable by the lateral faces being visible to the person more strongly or less strongly. The partial faces of the notch are visible to a different extent as a function of the relative position of the observer. If the observer or the person is situated further in the direction of the rear face of the basic body, the partial faces of the notch there are visible as relatively large areas compared to those of the notch of the front face. Consequently, counteraction can be taken by a displacement in the direction of the center of the basic body, that is to say in the direction of the front face. A positioning further in the direction of the front face correspondingly leads to a visibility over a larger area of the notch there, and to a corresponding remedy in the opposite direction.

Consequently, each of the notches and/or cutouts preferably has two preferably flat faces or partial faces. The partial faces preferably adjoin one another, in particular in the region of a common lateral edge. With further preference, the two adjoining partial faces are arranged at an angle to one another. The enclosed angle between the two lateral faces is preferably between 0° and 180°, preferably between 80° and 140°. In particular the angle is between 100° and 120° for optimum functioning, with further preference approximately 110°. Conversely, the angle enclosed between the partial face and the assigned outer face is preferably between 0° and 90°. In this case, it is preferred to propose between 30° and 40°, in particular approximately 35°, for optimum visibility. Preferably, an x-shaped marking is, in particular, provided on the top face of the basic body to improve the detectability of the x-shaped formation of said body. Said marking preferably extends diagonally between opposite corners of the top face.

In particular, the practice device and/or the basic body is designed completely or partially in one piece. A unipartite design ensures a very robust construction. On the other hand, the dismantleability is thereby reduced. Wood, plastics, metal and the like come into consideration as material. Combinations of various materials are also conceivable.

A use of a practice device according to the above-described configurations to check the alignment, in particular of a longitudinal axis (84) of the body and/or of a body part of a person (60) by the person (60) him/herself achieves the above-named object. The above statements relating to the practice device are likewise valid here in principle. Consequently, a practice device corresponding to the above statements is used to check the alignment, in particular, of the longitudinal axis of the body and/or of a body part of a person by the person him/herself. Consequently, the person can be positioned, or position him/herself, relative to the practice device and, if appropriate, independently detect deviations from the ideal position. The ideal position is considered to be a position that can be determined upon setting up the practice device on an underlying surface with lateral faces running at least substantially perpendicular to the underlying surface. In the ideal position of the person, the person is standing with both legs equally spaced apart from the practice device on different sides. The upper body is slightly angled forward. The eyes are respectively simultaneously positioned vertically above one of the lateral faces of the basic body. In this case, the left eye is situated in the plane of the left-hand lateral face, while the right eye is situated in the plane of the right-hand lateral face. This can be verified from the fact that neither of the two lateral faces, or a portion thereof that is as small as possible, is visible. A laterally deviating positioning leads to a (stronger) visibility of the lateral face in which the displacement has taken place. If one eye of the person is situated to the left of the left-hand lateral face, the latter is at least partially visible, while the right-hand lateral face is not visible at all or much less so. If the interocular distance corresponds to the distance between the lateral faces of the practice device, the person does not see the two lateral faces at all, or sees only the lateral edge thereof, if it is ideally positioned above the lateral faces with the respective eyes. In order to improve the alignment, it is therefore necessary to move away to the other side from the side whose lateral face is visible in general or at least visible to a larger extent than the other lateral face. Should the two lateral faces be simultaneously visible to a slight extent even given the ideal or central position, the interocular distance of the person is greater than the distance between the lateral faces. It is then necessary to ensure that the visible area of the two lateral faces is minimized for an ideal alignment. If the interocular distance is smaller than the distance between the lateral faces, an inaccuracy arises in the extent to which the person's head can move between the two planes of the lateral faces without one of the eyes being able to look laterally onto the face. It follows that there can be no visual alignment with the lateral faces in this region. Consequently, it is possible to conceive of the possibility of setting the distance between lateral faces or, alternatively, to conceive of an, if appropriate, personalized configuration of the practice device in the case of which the distance between the lateral faces is matched to the distance between the eyes of the user or the person in an individual fashion. Again, it is possible to select a suitable practice device from a number of prefabricated practice devices with different distances between the lateral faces.

A method for aligning a person relative to an underlying surface, namely, a method for aligning a person, in particular a golfer, relative to an underlying surface, with the aid of a practice device or the basic body thereof, as disclosed herein, in which at least one, preferably two lateral faces of the practice device are aligned at least substantially perpendicular to the underlying surface, in which the lateral faces become visible to the person to a different extent as a function of the position of the eyes of the person relative to the practice device achieves the above-named aim. In accordance therewith, the person, in particular a golfer, can be aligned, or can align himself, with the aid of a practice device in accordance with the above statements. To this end, the practice device has at least one, preferably two lateral faces, which are aligned at least substantially perpendicular to the underlying surface. Moreover, the lateral faces become visible to the person to a different extent as a function of the position of the eyes of the person. Depending on the positioning of the eyes, this means that the lateral faces become detectable not at all, or, as a function of the lateral deviation from the ideal position, to a corresponding extent as a surface that is more visible or less visible. The person can be moved in an opposite direction in order to compensate the deviation thus detected. To this end, the person or, correspondingly, the head or the upper body thereof, must be moved in the corresponding other direction away from the visible lateral face.

The lateral faces are more preferably simultaneously viewed with in each case one of the two eyes of the person. One of the two eyes is situated for this purpose in the plane of one lateral face, while the other eye is arranged in the plane of the other lateral face. This corresponds to the ideal position of the head of the person above the practice device or the basic body. The person is more preferably aligned in such a way that he/she looks with one eye along a first lateral face, and with the second eye along the second lateral face. In particular, to this end the basic body can be set up, or positioned relative to an underlying surface, in such a way that each eye of the person is respectively situated in one of the planes of the lateral face, preferably above the basic body, there preferably being a perpendicular arrangement of the planes relative to the underlying surface. It is thus ensured that the alignment can be performed by the person. To this end, the feet of the person are placed in such a way on both sides at the same distance from the practice device that the axis runs through the head and upper body, the longitudinal axis and upper body, in a perpendicular plane relative to the underlying surface. However, because of the foot position spaced apart from the basic body, the axis is inclined forward.

In particular, the visibility of the two lateral faces is simultaneously minimized in that a longitudinal axis of the body of the person is suitably displaced. In this case, a simultaneous aiming is preferably taken with in each case one eye along in each case one of the lateral faces. This corresponds to the arrangement of the eyes in one of the planes of the lateral face. A deviation, its extent and its direction can be detected visually at once by a simultaneous observation of the two lateral faces. A simultaneous minimization of the visible faces of two, preferably all the outer and lateral faces and/or partial faces is attempted for the optimum alignment of the person.

The practice device or the basic body is more preferably positioned, put down or laid down on the underlying surface, preferably with a bottom face. To this end, the bottom face is designed as setting up means and preferably designed to be at least virtually or partially flat. The bottom face or its contact points with the underlying surface are therefore arranged at least virtually parallel to the underlying surface. At least two lateral faces of the practice device are more preferably arranged at least substantially perpendicular to the underlying surface. The two lateral faces are aligned at least virtually parallel to one another. A distance between the lateral faces that corresponds to the mean or average interocular distance of a or the person is more preferably provided. This distance is preferably between 5 cm and 8 cm, preferably approximately 6.5 cm. 6.5 cm is known as the average human interocular distance. In general, this average distance suffices for the alignment. In particular, adjustability can be provided for the exact matching to a user, or alternatively it is possible to undertake a customized finishing of the practice device. In particular, the distance can also be set variably as a function of the interocular distance of the user or the person.

In particular, the practice device is put down on an underlying surface in such a way that the preferably parallel lateral faces are arranged at a preferably right angle to the underlying surface. The feet of the person are more preferably respectively positioned with the same distance between them laterally in the plane of the respective lateral face. In particular, the center is arranged between the eyes of the person perpendicularly above the practice device, or is arranged there such that the lateral faces are preferably not visible to the person or not visible to the same extent.

BRIEF DESCRIPTION OF THE DRAWINGS

Preferred exemplary embodiments of the invention are described in more detail below with the aid of the drawings, in which.

DETAILED DESCRIPTION OF PREFERRED EMBODIMENTS

Figure 1:
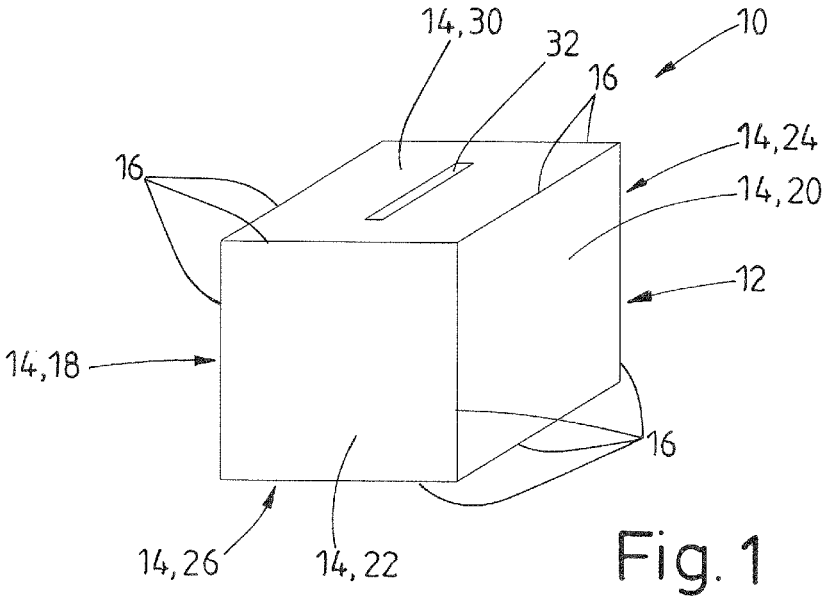
FIG. 1 shows a perspective view of a first exemplary embodiment of the invention.
Figure 2:
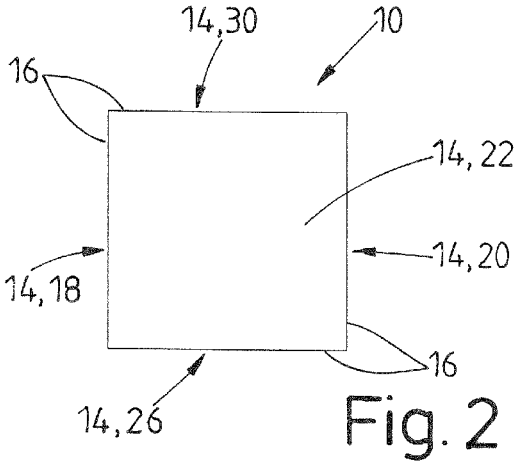
FIG. 2 shows a front view of the first exemplary embodiment.
Figure 3:
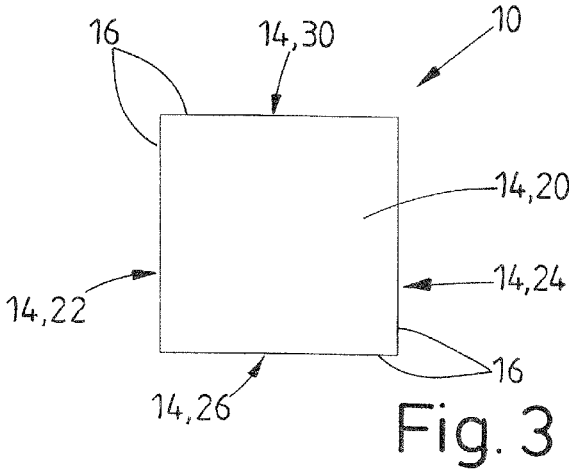
FIG. 3 shows a side view of the first exemplary embodiment of the invention.
Figure 4:
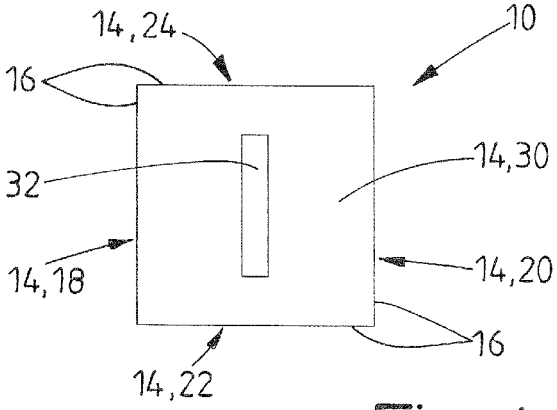
FIG. 4 shows a plan view of the first exemplary embodiment.
Figure 5:
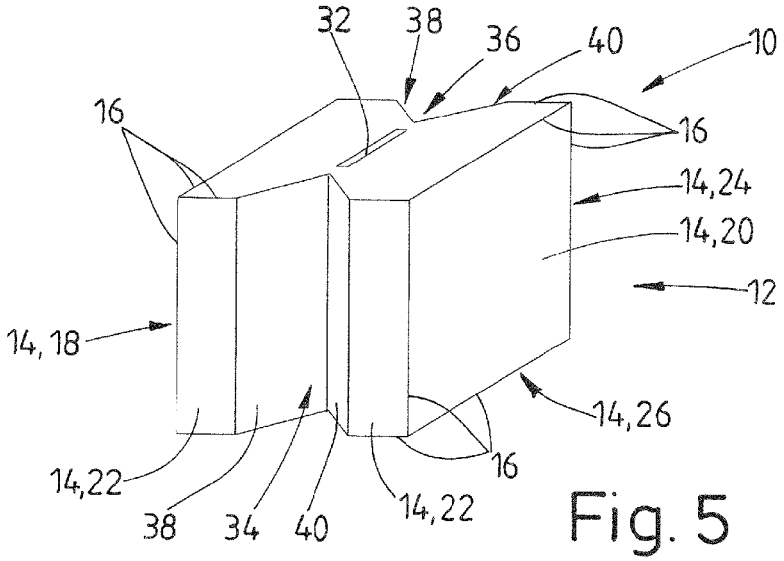
FIG. 5 shows a perspective view of a second exemplary embodiment of the invention.

FIGS. 1 to 4 show a practice device 10 as a first exemplary embodiment of the invention. In this case, the practice device 10 comprises in practice only a basic body 12.

This basic body 12 is designed in the shape of a cube. The basic body 12 accordingly has six outer faces 14. The outer faces 14 are of identical area and shape in this case. Square faces are involved in each case. Moreover, the outer faces 14 are of flat design.

In each case two of the outer faces 14 are arranged parallel to one another on opposite sides of the basic body 12. A lateral edge 16 is situated where two of the outer faces 14 meet at the edge. As a cube, the basic body 12 has twelve of these lateral edges 16. The two outer faces 14 meeting at one of the twelve lateral edges 16 are respectively designed in this case in a fashion running perpendicular to one another.

Two of the outer faces 14, specifically the left-hand lateral face 18 and the right-hand lateral face 20 running parallel thereto, are colored for better visibility. To this end, they have an all-over homogeneous coloration. A red coloring of the lateral faces 18 and 20 stands out particularly well in this case against, for example, a green underlying surface of grass. Alternatively, another color can be selected, for example for color-blind users. In each case, the two lateral faces 18 and 20 can be colored the same or purposely differently.

The front or rear outer face 14 respectively adjoining the lateral faces 18 and 20 is also denoted as front face 22 or as rear face 24, respectively, because of its arrangement. To improve visibility, they are likewise colored homogeneously with a color generally deviating from the color of the lateral faces 18 and 20. A vibrant color such as yellow or blue, for example, is suitable for this. Alternatively, it is also possible to provide the same coloration for all lateral outer faces 14, that is to say the lateral faces 18 and 20, the front face 22 and the rear face 24.

The bottom outer face 14 is designed as the bottom face 26. The practice device 10 stands on an underlying surface 28 with this bottom face 26. The bottom face 26 therefore serves as means for setting up on the underlying surface 28. Because of the partially perpendicular arrangement of the outer faces 14 relative to one another, the lateral faces 18 and 20, as well as the front face 22 and the rear face 24, stand perpendicularly or vertically on the bottom face 26 and thus the underlying surface 28. The upper outer face 14 designed as top face 30 is correspondingly arranged parallel to the bottom face 26 and thus also parallel to the underlying surface 28. To improve visibility, the top face 30 and, if appropriate, also the bottom face 26 are provided with a color deviating from the remaining outer faces 14.

The top face 30 has an, in particular black, marking 32 in the center of the face. The marking 32 is designed as a straight stripe, bar, line, or else as a cutout. In this case, it runs in the direction from the top lateral edge 16 of the front face 22 to the top lateral edge 16 of the rear face 24. In this case, it marks the middle between the top lateral edge 16 of the lateral face 18 and the top lateral edge 16 of the lateral face 20 or the left and right lateral edges 16 of the top face 30. The direction in which a user looks usually runs along this marking 32.

The second exemplary embodiment of the invention is illustrated in FIGS. 5 to 8. Here, as well, the practice device 10 has a basic body 12. It is chiefly only the deviations as contrasted with the first exemplary embodiment that are described below, since the basic construction is at least similar.

The basic body 12 of the second exemplary embodiment likewise shows a basic cubic shape. Here, at least parts of the outer faces 14 are arranged on the surface of a cube. In the region of the front face 22 and the rear face 24, however, notches 34 and 36 are present here. These notches 34 and 36 run respectively in perpendicular or vertical fashion when the practice device 10 is set up with the bottom face 26 on an underlying surface 28. The notches 34 and 36 recede into the interior of the basic body 12 from the respective parts of the front face 22 and of the rear face 24. They therefore extend from the outer faces 14 into the basic body 12. Consequently, two additional partial faces 38 and 40 are respectively provided as lateral bounding faces of the notches 34 and 36, respectively. The notches 34 and 36 are designed overall in the shape of a V or a wedge. The angles at which the partial faces 38 and 40 respectively run in a fashion angled away from the front face 22 and the rear face 24 are identical in this case for all four partial faces 38 and 40. Thus, the partial faces 38 and 40 also have the same surface area. They are designed as flat, rectangular faces.

In the region of the top face 30 and the bottom face 26, the notches 34 and 36 respectively penetrate the two faces. It is true that the basic surface of the top face 30 or of the bottom face 26 is square as previously. However, the two faces are not designed as square faces. Specifically, because of the wedge-shaped notches 34 and 36, in each case sections which are triangular at the edges thereof are provided in the region between the lateral edges 16 and the front face 22 and the rear face 24. It follows that the lateral edges 16 run partially in the region of the lateral faces 18 and 20 and respectively run along said square basic surface in the region of the front face 22 and the rear face 24. Only the partial faces 38 and 40 cut out equilateral triangular parts from the top face 30 and also from the bottom face 26. The lateral edges 16 therefore run along the triangular cutouts in this region.

Partial faces 38 and 40 enclose an angle of approximately 110° here. This corresponds to an angle of approximately 35° between each of the partial faces 38 and 40 in the case of each of the notches 34 and 36, and the front face 22 or the rear face 24.

Figure 6:
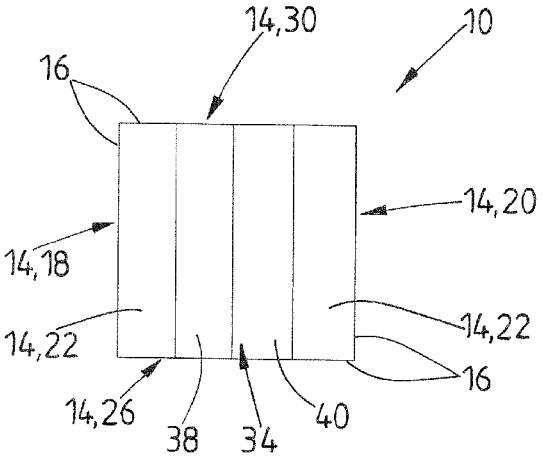
FIG. 6 shows a front view of the second exemplary embodiment.
Figure 7:
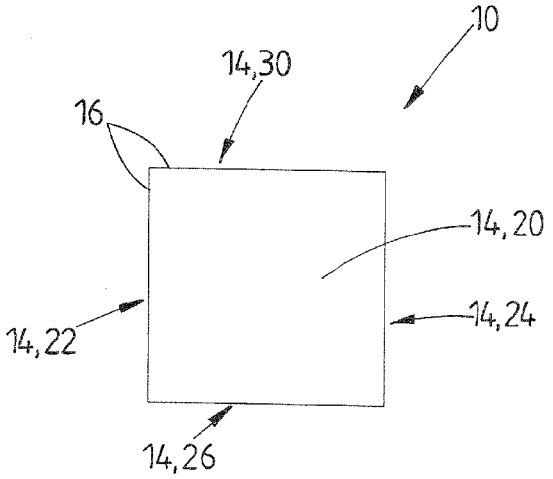
FIG. 7 shows a side view of the second exemplary embodiment.
Figure 8:
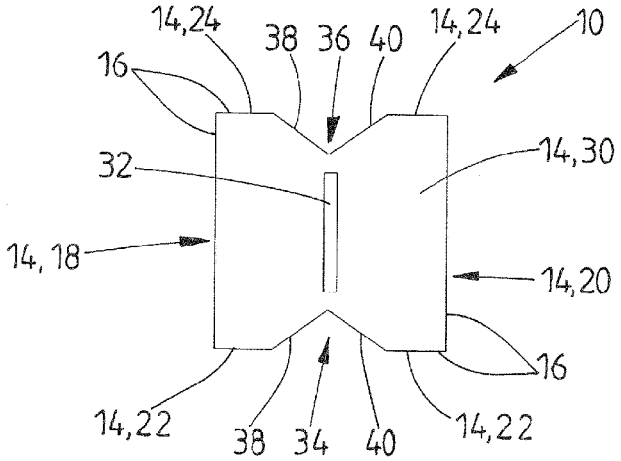
FIG. 8 shows a plan view of the second exemplary embodiment.

In the view of the front face 22 in accordance with FIG. 6, it is to be seen that the four surfaces to be recognized in this view, specifically the left-hand part of the front face 22, the partial faces 38 and 40 and the right-hand part of the front face 22, are designed at approximately the same width in the frontal view. However, it is also conceivable to change the relationship of the width of the notch 34 or 36 relative to the edge regions 14, 22. The edge regions or sections of the front face 22 should, however, be designed with equal width in each case, just as should the two partial faces 38 and 40. This ensures that a central arrangement of the notches 34 and 36 results, on the one hand, and, at the same time, the notch 34 or 36 is a triangular equilateral basic shape or cross-sectional area of the cutout wedge. The above is true both for the front face 22 and, correspondingly, for the rear face 24, which is designed in a fashion virtually identical to the first. In the plan view according to FIG. 8, the top face 30, and therefore the entire basic body 12, consequently has a shape that might be called an X shape. Consequently, the exemplary embodiment shown here is also denoted as an "X-cube".

Figure 9:
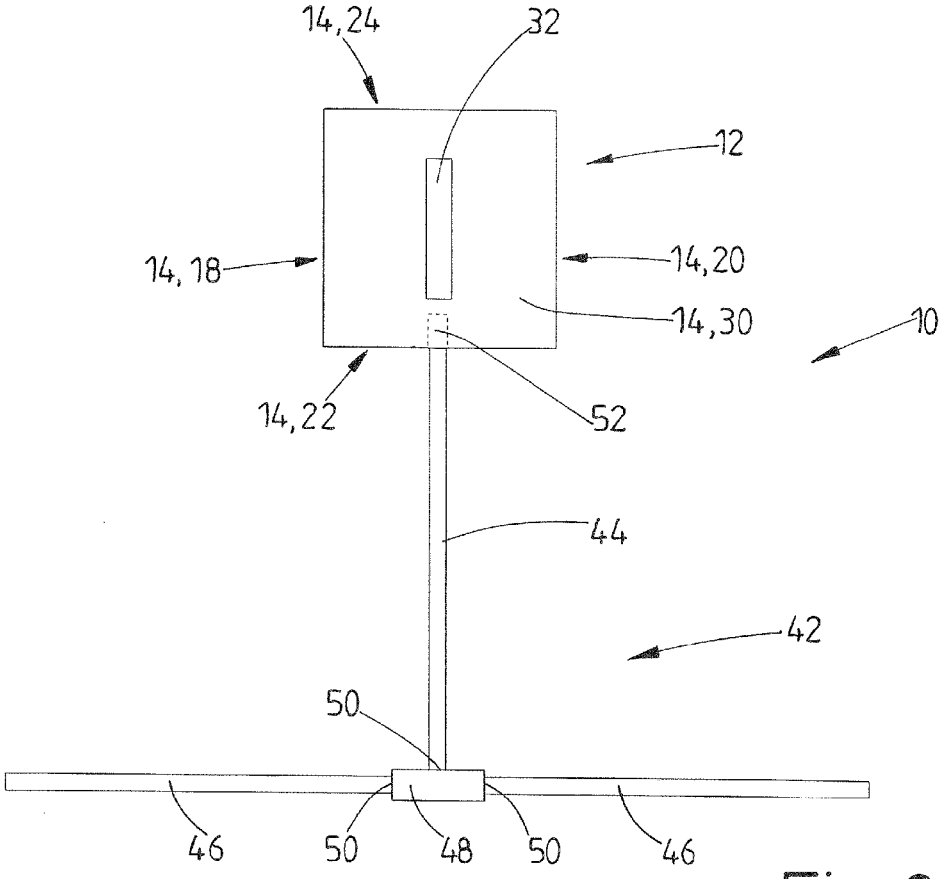
FIG. 9 shows a plan view of a third exemplary embodiment of the invention.
Figure 10:
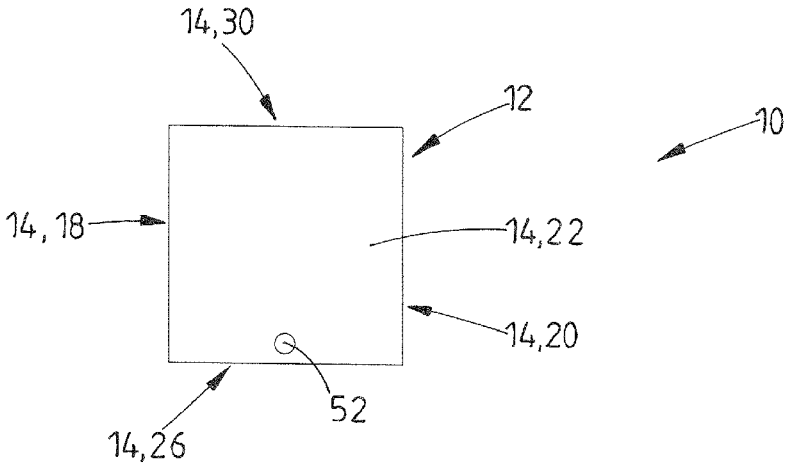
FIG. 10 shows a sectional view of the front face of the third exemplary embodiment.

The third exemplary embodiment of FIGS. 9 and 10 is based on the first exemplary embodiment shown in FIGS. 1 to 4. Consequently, as shown here, the basic body 12 of the practice device 10 is designed to be virtually identical to that of the first exemplary embodiment. Alternatively, by way of example, it is also possible, however, to replace the basic body 12 with the basic body 12 of the second exemplary embodiment, or other alternative designs of the invention. The changes described below are then to be undertaken as appropriate.

The basic body 12 is therefore of cubic design here. Connected thereto is an alignment indicator 42. Said alignment indicator 42 is substantially designed in the shape of a T. To this end, three bars 44 and 46 are interconnected. The two bars 46 are interconnected and connected to the bar 44, perpendicular to them, by means of a coupling sleeve 48. The two bars 46 are aligned collinearly with one another. The bars 44 and 46 are preferably plugged or screwed into the coupling sleeve 48. To this end, the coupling sleeve has three holders or openings 50 with preferably corresponding internal threads. The bars 44 and 46 correspondingly have external threads corresponding to these internal threads. They can therefore be screwed into the coupling sleeve 48. Alternatively, it is also possible to provide a for example latchable plug connection.

The end of the bar 44 that is opposite the coupling sleeve 48 can be connected to the basic body 12. To this end the basic body 12 has a holder or opening 52. The bar 44 can be plugged or inserted into this opening 52. An external thread corresponding to an internal thread in the opening 52 is arranged at the end region of the bar 44 for the purpose of particularly stable holding. The bar 44 can therefore be screwed into the basic body 12. However, as an alternative, it is also possible here to provide an in particular latchable plug connection or the like. The opening 52 is arranged at the bottom region of the front face 22 of the basic body in the vicinity of the bottom lateral edge 16 relative to the bottom face 26. Moreover, the opening 52 is provided centrally between the two lateral faces 18 and 20 in the bottom region of the front face 22. Consequently, the alignment indicator 42 lies overall at least substantially flat on the ground or underlying surface 28 when it is connected to the basic body 12 and the latter is set up with its bottom face 26 on the underlying surface 28.

Owing to the screwing means, which can as an alternative also be designed as a plug system, the alignment indicator 42 can be dismantled and therefore easily transported. By arranging a corresponding opening 52 in the region of the notch 34 of the basic body 12, for example, of the second exemplary embodiment, the alignment indicator 42 can also easily be combined with said second exemplary embodiment, or else with further alternative designs of the invention.

With the aid of FIGS. 11 and 12, the practice device, its method of operation, the use of the practice device and the corresponding method are described below:

The description is undertaken with the aid of a practice device according to the third exemplary embodiment of the invention. The cubic basic body 12 to which the alignment indicator 42 is connected is thereby provided. As described above, the T-shaped alignment indicator 42 has a bar 44 and two collinear bars 46 that are perpendicular thereto. A coupling sleeve 48 serves to connect said bars. The practice device 10 with basic body 12 and alignment indicator 42 is arranged lying on the underlying surface 28. Consequently, the bars 44 and 46 run at least substantially parallel to the underlying surface 28.

Figure 11:
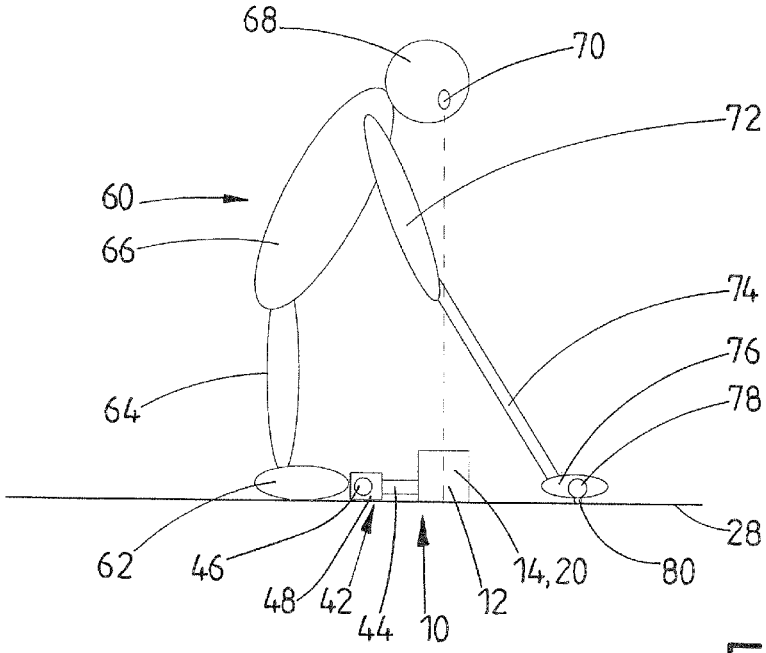
FIG. 11 shows a side view of a person in the case of the observation of the third exemplary embodiment of the invention.
Figure 12:
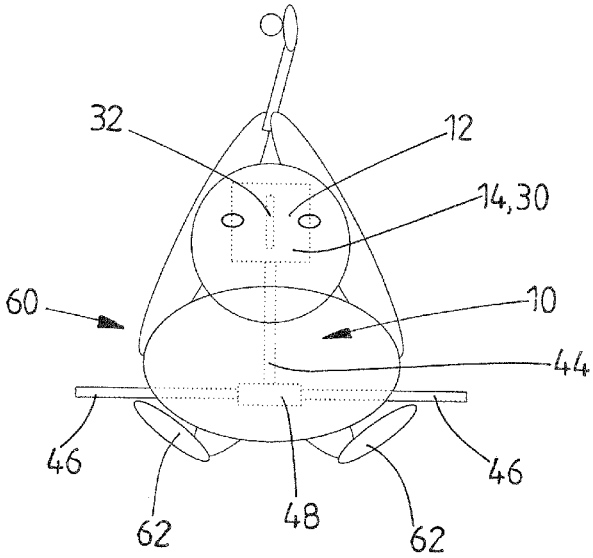
FIG. 12 shows a plan view in accordance with FIG. 11.

A person 60 is sketched in FIGS. 11 and 12 in order to explain the use and the method. The person 60 is standing with his/her two feet 62 on the underlying surface 28. Two legs 64 aligned substantially vertically support in this case an upper body 66 that is angled away slightly forward or in an inclined manner. The upper body 66 is inclined forward in such a way that a head 68 of the person 60 is situated substantially above the basic body 12 of the practice device 10. In particular, two eyes 70 in the head 68 of the person 60 are positioned above the basic body 12.

The person 60 can be a golfer. Consequently, with his/her arms 72 the person 60 holds a golf club 74 in a fashion directed obliquely downward in the direction of the underlying surface 28. A club head 76 of the golf club 74 is situated in this case at the level of and next to a golf ball 78. As is usual, the golf ball 78 is laid onto a small peg 80, the so-called "tee", that is plugged with a pointed end into the underlying surface 28, for example a grassy area of a golf course.

In order to explain the alignment of the head 68 above the basic body 12, FIG. 11 shows a dashed line 82 that runs perpendicular to the underlying surface 28 and simultaneously marks the direction in which the eyes 70 are looking. The feet 62 of the person 60 are placed on the side of the two bars 46 averted from the basic body 12. In this case, the bar 44 or the coupling sleeve 48 is situated substantially on a central line between the two feet 62. Owing to the slightly forward inclination of the upper body 66, the head 68 of the person 60 runs above the basic body 12. The feet 62 are placed at the same distance respectively left and right of an imaginary extension of the bar 44 beyond the coupling sleeve 48. As a result of this, the upper body 66 is aligned with a longitudinal axis 84 of the body, which runs along the bar 44, in a vertical plane in a longitudinal direction of the valve 44 when the head 68 of the person 60 is situated centrally above the basic body 12 (see FIG. 12). As soon as the head 68 moves, for example, laterally in the direction of one of the lateral faces 18 or 20, the longitudinal axis 84 of the body is no longer situated in the same vertical plane with the bar 44. The aim is to avoid and/or correct these disadvantageous, lateral deviations that occur during a golf swing for executing a strike with the golf club 74.

The person 60 can now easily check the correct or ideal position or alignment of the longitudinal axis 84 of the body: to this end, the basic body 12 has a transverse dimension or a distance between the lateral faces 18 and 20 that precisely corresponds to the interocular distance of the two eyes 70 of the person 60. This is illustrated in FIG. 12. Given an ideal alignment, on the one hand, the person 60 respectively looks with one of the eyes 70 onto each of the two lateral edges 16 of the lateral face 18 or lateral face 20. It follows that the person perceives the respective lateral face 18 or 20 only as a line in the form of the lateral edge 16. Given an ideal alignment, on the other hand, the feet 62 are arranged at the same distance apart on in each case one side of the plane of the bar 44. Moreover, they are positioned in a fashion distanced from the basic body 12, in particular on the side of the bars 46 that is averted from the basic body 12. The longitudinal axis 84 of the body therefore runs through the upper body 66 and head 68 in one plane with the bar 44.

In order to amplify the visual effect, the lateral faces 18 and 20 are designed in a color standing out clearly from the underlying surface 28. Since the underlying surface 28 is usually a grassy area, an intensive color, such as the color red, is frequently provided in this case. The marking 32 on the top face 30 of the basic body 12 serves in all cases to indicate the lateral center of the basic body 12. It can serve as a further reference point for the alignment of the person 60.

As soon as the head 68 moves laterally in one direction, the corresponding eye 70 comes with its viewing direction next to the basic body 12. Owing to the lateral positioning, the person 60 can look obliquely from above onto the lateral faces 18 and 20 with the aid of the eye 70 situated laterally next to the basic body 12. The lateral face 18 or 20 is now no longer perceptible as a line, but as a surface becoming larger with increasing lateral deviation.

In order to correct the alignment of the longitudinal axis 84 of the body, the person 60 need only determine which of the two eyes 70 perceives one of the two faces 18 and 20 as a surface, or which eye 70 perceives a relatively large area. A lateral deviation from the center of the basic body 12 outward therefore exists in the direction of the eye 70 that perceives the relatively large lateral face 18 or 20. To correct this deviation, the person 60 must move with his/her head 68 in accordance with the upper body 66, therefore in an opposed direction. This therefore means that when the left eye 70 perceives a relatively large part of the lateral face 18 than does the right eye 70 of the lateral face 20, the person 60 must move to the right in the direction of the lateral face 20 in order to correct this deviation. A corresponding statement holds in the opposite case when the perception of the right-hand lateral face 20 is greater than that of the left-hand lateral face 18. The person 60 must then move correspondingly to the left in the direction of the lateral face 18.

The notches 34 and 36 of the second exemplary embodiment can serve also to be able to perceive a deviation of the positioning of the longitudinal axis 84 of the body from the ideal position in the direction parallel to the bar 44. Owing to the partial faces 38 and 40 which run completely inward in relation to the front face 22 and the rear face 24, given a positioning of the eyes 70 in a line with the middle between the lateral edges 16 of the front face 22 and the rear face 24, the person 60 sees the partial faces 38 and 40 as areas of the same size.

As soon as the head 68 moves upward or downward along the direction of the bar 44 in the plane of the sheet, that is to say forward or rearward, thus in the direction of the front face 22 or the rear face 24, as seen by the person 60, there is a change in the perceived areas of the partial faces 38 and 40. The result of a forward movement is that the partial faces 38 and 40 of the rear face 24 of the basic body 12 are visible as larger areas than those of the front face 22. This is correspondingly the other way around given a rearward movement. Consequently, the practice device 10 can be used to determine whether the longitudinal axis 84 of the body is optimally aligned for carrying out a strike when playing golf. This can respectively be done even by the person 60 himself without the aid of a third party.

LIST OF REFERENCE NUMERALS

10 Practice device
12 Basic body
14 Outer face
16 Lateral edge
18 Lateral face
20 Lateral face
22 Front face
24 Rear face
26 Bottom face
28 Underlying surface
30 Top face
32 Marking
34 Notch
36 Notch
38 Partial face
40 Partial face
42 Alignment indicator
44 Bar
46 Bar
48 Coupling sleeve
50 Opening
52 Opening
60 Person
62 Foot
64 Legs
66 Upper body
68 Head
70 Eyes
72 Arm
74 Golf club
76 Club head
78 Golf ball
80 Peg
82 Line
84 Longitudinal axis of the body

What is claimed is:

1. A practice device for checking the alignment of a person (60), in particular a golfer, by a person (60) him/herself and relative to an underlying surface (28), comprising:

a many-faced basic body (12) which is basically in the shape of a polyhedron with at least partially flat outer faces (14) that are parallel in pairs and comprise at least two lateral faces (18, 20), a front face (22) and a rear face (24); and means for setting up on an underlying surface (28), at least the lateral faces (18, 20), the front face (22) and the rear face (24) being aligned at least substantially perpendicular to an imaginary plane running through the setting up means, wherein the two opposite lateral faces (18, 20) are arranged at a distance that corresponds at least substantially to a human interocular distance of between 5 cm and 8 cm, the two opposite lateral faces (18, 20) respectively having a wedge-shaped or V-shaped notch (34, 36) that respectively extends in a vertical direction.

2. The practice device as claimed in claim 1, wherein the distance of the front face (22) and the rear face (24) from one another is at least substantially the interocular distance of a person (60).

3. The practice device as claimed in claim 1, wherein the distance of the front face (22) and the rear face (24) from one another is between 5 cm and 8 cm.

4. The practice device as claimed in claim 1, wherein the distance between the two lateral faces (18, 20) is variable.

5. The practice device as claimed in claim 1, wherein the basic body (12) has several of the outer faces (14) that are at least partially flat faces arranged oppositely pairwise.

6. The practice device as claimed in claim 5, wherein at least the two lateral faces (18, 20) are designed as flat rectangular faces arranged parallel to one another.

7. The practice device as claimed in claim 1, wherein the basic body (12) has six of the outer faces (14), and the basic body (12) is basically in the shape of a cube with the six outer faces (14) that are at least partially flat faces arranged oppositely pairwise, with a top face (30) and a bottom face (26).

8. The practice device as claimed in claim 7, further comprising a marking (32) on the top face (30) of the basic body (12).

9. The practice device as claimed in claim 8, wherein the marking (32) is a bar, a line or a cutout, arranged centrally on the top face (30) of the basic body (12).

10. The practice device as claimed in claim 1, wherein the lateral faces (18, 20) are colored or color coded.

11. The practice device as claimed in claim 10, wherein the lateral faces (18, 20) are colored red or yellow, and the top face (30) is colored green.

12. The practice device as claimed in claim 1, further comprising a T-shaped alignment indicator (42) having several elements (44, 46) that are detachably connected to one another, and are in the shape of bars and/or rods.

13. The practice device as claimed in claim 12, wherein the T-shaped alignment indicator (42) is detachably connected to the basic body (12) by screws or plugs.

14. The practice device as claimed in claim 12, wherein the T-shaped alignment indicator (42) has three elements or bars (44, 46) and the basic body (12) has at least one holder or opening (52) for holding at least one of the elements (44).

15. The practice device as claimed in claim 1, wherein the notch (34, 36) is arranged centrally on a respective face.

16. The practice device as claimed in claim 15, wherein the notch (34, 36) extends over the entire face between the top face (30) and the bottom face (26).

17. The practice device as claimed in claim 1, wherein the notches (34, 36) of two opposite faces run parallel to one another and are oppositely aligned and point into the basic body (12).

18. The use of a practice device (10) as claimed in claim 1, to check the alignment of a longitudinal axis (84) of a body and/or of a body part of a person (60) by a person (60) him/herself.

19. A method for aligning a person (60), in particular a golfer, relative to an underlying surface (28), with the aid of the practice device (10) as claimed in claim 4, comprising:

aligning the at least two parallel lateral faces (18, 20) of the practice device (10) at least substantially perpendicular to the underlying surface (28), wherein the lateral faces (18, 20) and/or the faces of the notches (34, 36) become visible to a person (60) to a different extent as a function of the position of eyes of a person (60) relative to the practice device (10), and adapting the distance between the lateral faces (18, 20) to correspond to the mean interocular distance of a person (60) of approximately between 5 cm and 8 cm.

20. The method as claimed in claim 19, further comprising:

positioning the practice device (10) on the underlying surface (28), with a flat bottom face (26), arranging the at least two lateral faces (18, 20) of the practice device (10) at least substantially perpendicular to the underlying surface (28) and at least substantially parallel to one another, with a distance between them that corresponds to the mean interocular distance of a person (60), the distance being set variably as a function of the interocular distance of a person (60);

positioning feet (62) of a person (60) respectively with the same distance between them laterally outside or next to the basic body (12) and next to the plane of the respective lateral face (18, 20); and arranging the center between eyes (70) of a person (60) perpendicularly above the practice device (10), the lateral faces (18, 20) not being visible, or being visible to the same extent.

21. The method as claimed in claim 20, wherein the distance between the at least two lateral faces is between 5 cm and 8 cm.

22. The method as claimed in claim 19, further comprising varying the distance between the opposite lateral faces (18, 20) continuously to match the interocular distance of a person (60).

23. The method as claimed in claim 22, wherein the degree and the direction of the deviation of the longitudinal axis (84) of a body of a person (60) from a predetermined alignment is visually acquired by a person (60) by the perceptible size of the lateral faces (18, 20) or their relationship to one another.

24. The method as claimed in claim 23, wherein by displacing a longitudinal axis (84) of a body of a person (60) the visibility of the two lateral faces (18, 20) is simultaneously minimized, an aiming being taken simultaneously with in each case one eye (70) along in each case one of the lateral faces (18, 20).

25. The method as claimed in claim 19, wherein the basic body (12) is set up relative to the underlying surface in such a way that each eye (70) of a person (60) is respectively situated in one of the planes of the lateral faces (18, 20) above the basic body (12), and wherein at least two of the lateral faces (18, 20) are arranged in such a way that a deviation of the position of a person (60) from the optimum position is visually detectable.

26. The method as claimed in claim 19, further comprising viewing the outer lateral faces (18, 20) of the basic body (12) simultaneously with in each case one of two eyes such that a person (60) is aligned in such a way that he/she looks with one eye (70) along the first lateral face (18, 20) and with another eye (70) along the second lateral face (18, 20).

27. The method as claimed in claim 26, further comprising setting up the basic body (12) relative to the underlying surface in such a way that each eye (70) of a person (60) is respectively situated in one of the planes of the lateral faces (18, 20), there being a perpendicular alignment relative to the underlying surface (28).

28. The method as claimed in claim 26, further comprising selecting the distance between the two lateral faces (18, 20) in such a way that a person (60) takes aim simultaneously in each case with one eye (70) along in each case one of the two lateral faces (18, 20), wherein, given a central alignment relative to the basic body (12), exactly the same area of the lateral faces (18, 20) becomes visible on both sides with both lateral faces (18, 20) being precisely not or minimally visible, and wherein, given an already slight lateral deviation from the angularly correct or ideal alignment of a person (60), a relatively large area of at least one of the lateral faces (18, 20) becomes visible, at least with one of two eyes (70).

29. The method as claimed in claim 28, wherein the distance between the opposite lateral faces (18, 20) is permanently selected.

* * * * *